US005680681A

United States Patent [19]

Fuss

[11] Patent Number: 5,680,681

[45] Date of Patent: Oct. 28, 1997

[54] THEFT DETERRENT GARMENT TAG WITH INK IDENTIFICATION

[76] Inventor: Arthur Fuss, 4235 Mary Ellen Ave., #301, Studio City, Calif. 91604

[21] Appl. No.: 697,528

[22] Filed: Aug. 26, 1996

[51] Int. Cl.[6] ..... A44B 9/00

[52] U.S. Cl. ..... 24/704.1; 70/57.1

[58] Field of Search ..... 24/704.1, 704.2, 24/711.4; 70/57.1; 340/572; 109/25

[56] References Cited

U.S. PATENT DOCUMENTS

| | | | |
|---|---|---|---|
| 4,944,075 | 7/1990 | Hogan | 70/57.1 X |
| 5,022,244 | 6/1991 | Charlot, Jr. | 70/57.1 |
| 5,031,287 | 7/1991 | Charlot, Jr. et al. | 24/704.1 |
| 5,054,172 | 10/1991 | Hogan et al. | 24/704.1 |
| 5,275,122 | 1/1994 | Stolz et al. | 70/57.1 X |
| 5,388,433 | 2/1995 | Andersson et al. | 24/704.1 X |

*Primary Examiner*—James R. Brittain
*Attorney, Agent, or Firm*—Roger A. Marrs

[57] ABSTRACT

A theft deterrent garment tag having a first housing with an internal cavity occupied by a pair of fragile vials fixedly held in position over slots or openings containing a garment staining substance such as ink and a movable vial fracturing element adjacent openings provided in the first housing permitting flow of released substance into the garment when tempered with by unauthorized personnel. An antenna including a diode is carried in the first housing suitable for use in an electronic surveillance situation and hold-down ribs are included for supporting the antenna in position in the first housing. A second housing includes a receptacle midway between its opposite ends for insertably receiving the shank of an elongated pin downwardly depending from the fracturing element movably carried on the first housing whereby securement of the housings is made on opposite sides of the fabric of the garment.

10 Claims, 2 Drawing Sheets

FIG. 4
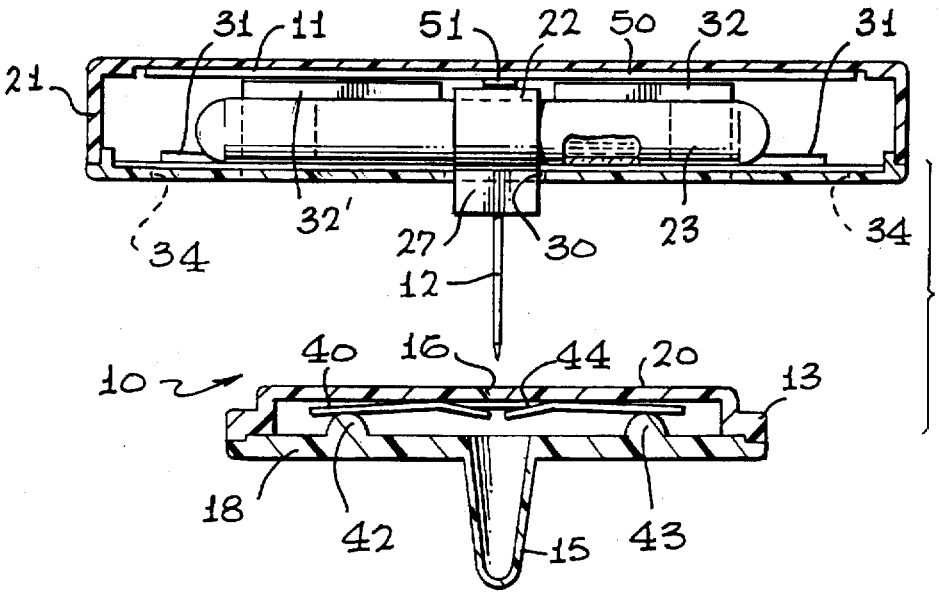
FIG. 5
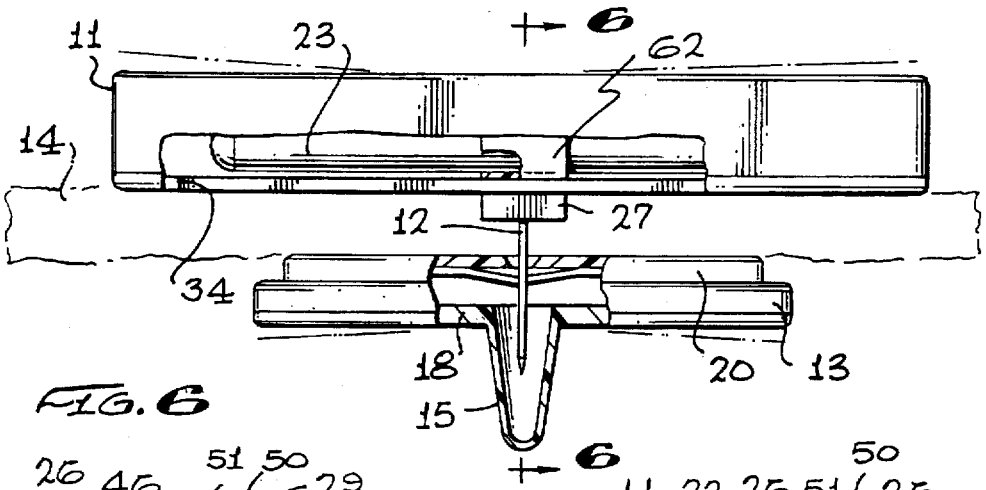
FIG. 6
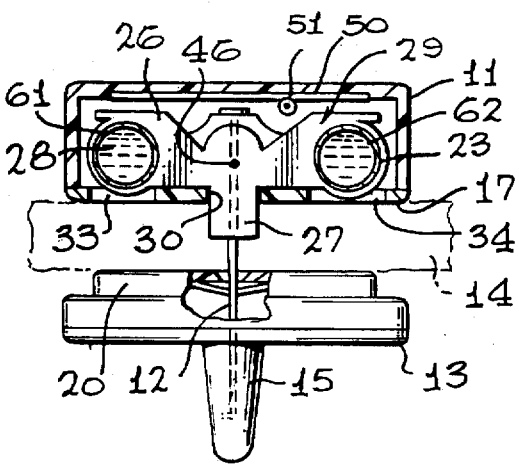
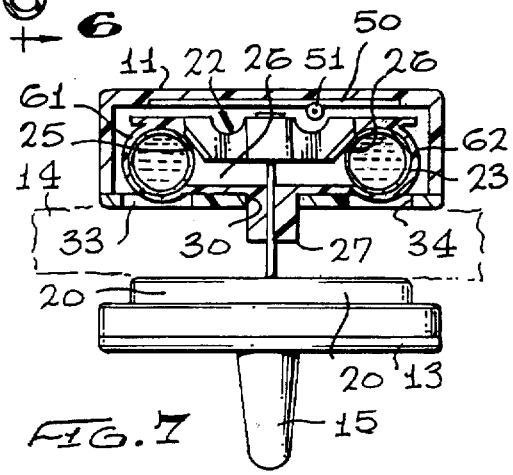
FIG. 7

THEFT DETERRENT GARMENT TAG WITH INK IDENTIFICATION

BACKGROUND OF THE INVENTION

1. Field of the Invention

The present invention relates to combined electronic and detrimental substance containing theft deterrent devices, and more particularly to a novel device that may be attached to articles, such as garments or other merchandise, for deterring the theft of such articles, including combined means for electronic surveillance and for releasing a detrimental substance such as ink or the like when the device is tampered with during an unauthorized attempt to remove the device from the article. 2. Brief Description of the Prior Art In the past, a wide variety of conventional devices have been employed using ink as the detrimental substance for staining the fabric of a garment when unauthorized attempts have been made to remove the tag from the garment. Usually the theft/deterrent substance is contained in one or more frangible containers, such as tubes or vials comprised of glass or rigid plastic which are carried in the housing of the tag. The housing is secured to the garment to be protected by an attachment structure of a type which is releasable upon use of specialized release devices by authorized personnel. Such attachment generally takes the form of a pin carried on one section of the tag which is pushed through a layer of the fabric of the garment into a receptacle carried on another section of the tag. The substance contained within the vials is released when a fracturing element is flexed so that the vial is broken, releasing the substance.

Problems and difficulties have been encountered when using such conventional devices such as disclosed in U.S. Pat. Nos. 5,031,287 or 5,309,740, which stem largely from the fact that adequate support for the vials within the housing is difficult since the vials must be restrained in position so that inadvertent fracture will not occur. Also, the fragile vials must be supported in such a manner that breakage will not occur inadvertently when the tag is removed by personnel using authorized tag removal devices. Additionally, such conventional devices employ only the mechanical means for deterring unauthorized removal of the tag. However, in other instances, it is preferred to employ an electronic device which will emit a signal indicating that the garment has been removed from an authorized area to an unauthorized area. Such electronic devices include a transmitter/receiver device using RF energy and in other instances, magnetic means are provided to effect electronic detection. Generally, the components for either the RF or magnet devices are carried on a plate in the center of the tag and used independently of devices using the fragile vials carrying the deterrent substance.

Therefore, a long-standing need is present to provide a novel garment security tag for supporting frangible vials of a staining substance that that inadvertent breakage will nor occur during authorized tag removal and additionally, so that electronic or magnetic means can be combined in the tag for alarm in the event of unauthorized removal of the article beyond a restricted perimeter. Support of the vials and breakage means for vials is of importance so that breakage occurs only when unauthorized disturbance or separation of tag components occurs.

SUMMARY OF THE INVENTION

Accordingly, the above problems and difficulties are avoided by the present invention which provides for a theft deterrent garment tag which includes a first and a second housing. The first housing includes a pair of fragile vials containing a garment-staining substance which is supported on a fixed holder adjacent to slots defining openings in the first housing through which released substance can enter the fabric of the garment. The vials are physically dimensioned of reduced size as compared with the openings. The holder supports an element considered to be a fracturing means or breaker bar which is movably or loosely carried on the holder and having opposite ends engageable with the vials. A second housing is provided which includes an elongated receptacle positioned between its opposite ends for receiving an elongated shank of a pin carried on the fracturing element so that the housings may be attached to the garment when the pin shank is inserted into the receptacle through the layer of fabric of the garment. Unauthorized tampering of the installed or assembled tag will cause the fracturing element to move within the first housing to fracture the vials so as to release the substance through the slot openings into the fabric of the garment.

Another feature resides in incorporating electronic surveillance means in the first housing in the form of an antenna circuit such that the circuit and its components will not interfere with the fracturing means or the vials. A pair of spaced-apart ribs are carried in the first housing bearing against the antenna circuit for retention and securement purposes. In this manner, both electronic surveillance means and garment damaging means are combined into the unity garment security construction.

Another object of the present invention is to provide a novel fracturing means for use in a security tag for articles whereby fragile vials of fabric staining substance can be released when the fracturing element is moved beyond its support position.

Yet another object of the present invention is to provide a security tag which combines not only the mechanical effects and means for distributing a deterrent substance into the article but includes electronic or magnetic means as well.

Still a further object of the present invention resides in the provision of a security tag for garments which includes a fracturing element employed to support fragile vials within the housing in combination with slots provided in the housing suitable for conducting released substance from the vials into adjacent fabric of the garment and wherein the slots are of larger size than the size of the vials.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 4 a greatly enlarged longitudinal cross-sectional view of the first and second housings and their components as used in the theft deterrent garment tag of the present invention and illustrating the inclusion of an electronic surveillance means carrying components responsive to incident energy to radiate alarm-indicating signals;

FIG. 5 is a view similar to the view of FIG. 4 illustrating assembly of the first and second housings on opposite sides of fabric of the garment and further illustrating the effects of unauthorized detachment causing movement of the fracturing element in accordance with the invention;

FIG. 6 is transverse cross-sectional view of the theft deterrent garment bag shown in FIG. 5 as taken in the direction of arrows 6—6 thereof;

FIG. 7 is a view similar to the view of FIG. 6 illustrating the wobbling movement of the fracturing element when unauthorized removal is encountered.

DESCRIPTION OF THE PREFERRED EMBODIMENT

Figure 1:
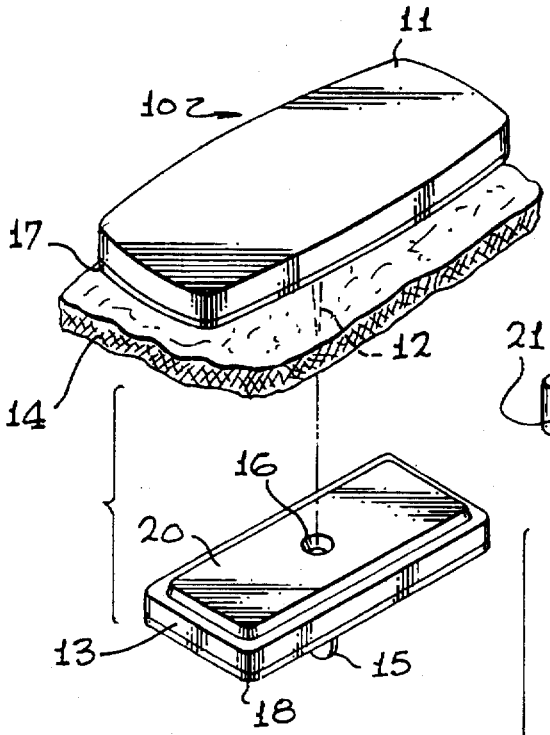
FIG. 1 is an exploded perspective view showing the housing of the present invention preparatory for assembly on opposite sides of an article intended to be monitored.

Referring to FIG. 1, the novel theft deterrent garment tag of the present invention is illustrated in the general direction of arrow 10 which includes a first housing 11 having a downwardly depending shank of a pin protruding underneath the housing and located midway between its opposite ends. The shank of the pin is indicated by numeral 12 and is intended to be assembled with a second housing 13 which is located on the opposite side of the fabric of a garment or article, as indicated by numeral 14. The second housing 13 includes an elongated receptacle 15 having an opening 16 in the surface of the housing. The entrance 16 to the receptacle 15 is conical so that the point of pin 12 may be automatically centered and directed into the receiving receptacle. The first housing 11 includes an internal cavity for holding components of the device and the cavity is closed by a bottom panel 17 which includes a central slot through which the shank 12 of the pin passes externally of the housing. The second housing 13 includes an internal storage cavity for components and includes a bottom panel 18 for closing the cavity of the second housing. The housing further carries a pressure plate 20 adapted to reside against the fabric of the garment 14 when the first and second housings are assembled together, as shown in FIG. 2.

Figure 2:
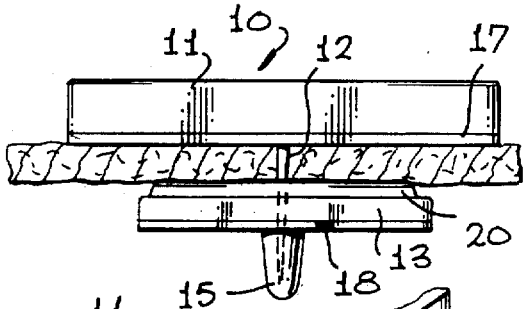
FIG. 2 is a side elevational view of the theft deterrent garment tag of the present invention illustrated in its assembled position.
Figure 2:
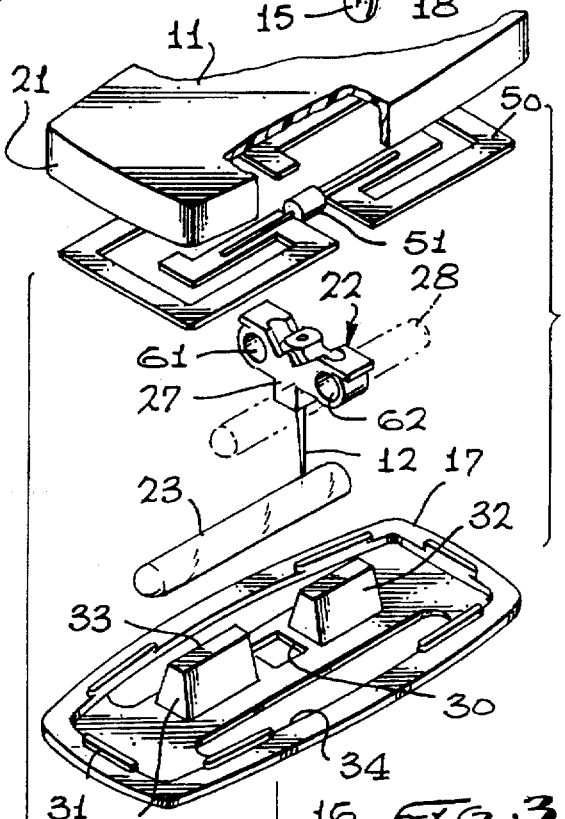

Referring now to FIG. 2, it can be seen that the first housing 11 and the second housing 13 are joined together by the pin 12 which is forcibly urged through the material 14 which separates the bottom panel 17 from the pressure plate 20. The fabric of the garment is illustrated as being compressed when the housings are forcibly joined together.

Figure 3:
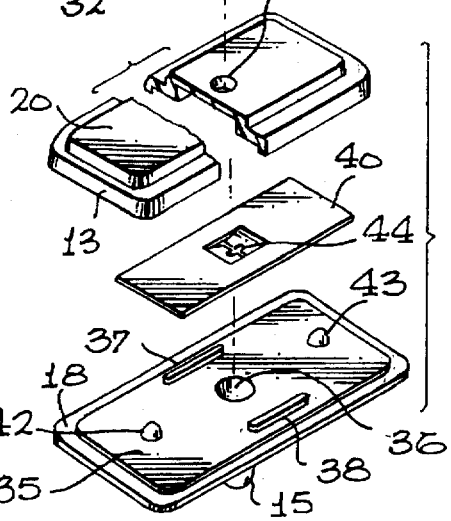
FIG. 3 is an enlarged exploded view illustrating the components of the theft deterrent garment tag shown in FIGS. 1 and 2.

Referring now in detail to FIG. 3, it can be seen that the first housing 11 is elongated with a continuous sidewall 21 that defines the periphery of the internal cavity into which components reside. One of the components within the interior cavity is a fracturing device or breaker bar 22 for breaking at least one of a pair of fragile vials 23 (one shown) in the event of unauthorized tampering with the device. The fracturing element 22 includes a central body 24 having lateral arcuate portions 25 and 26 outwardly projecting from the body 24. Downwardly depending from the central body 24 is a projection 27 through which the pin 12 passes in a downwardly depending position. Therefore, the fracturing device or breaking bar 22 integrally includes the pin 12 along with the arcuate portions 25 and 26 which are effective for fracturing or breaking the fragile vial 23 and an identical component 28.

Figure 8:
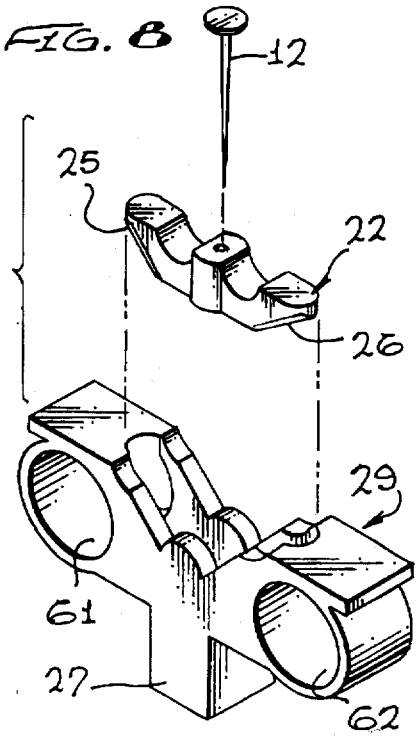
FIG. 8 is an enlarged exposed perspective view of the vial holder and breaker bar or element shown in FIG. 3.

The vials are held and supported by a holder 29 having a central body 60, see FIG. 8, with lateral circular retainers 61 and 62 that are provided with bores for insertably receiving and holding the vials. The fracturing element 22 nests in an opening 63 with the pin 12 extending through the body 60 of the holder. The fracturing device may pivot within the opening 63 about its engagement with the body 60 so that its laterally extending ends 25 and 26 forcibly engage with either or both vials causing fracture. The holder is substantially stationary with the bottom panel 17 but will wobble in response to movement of the pin and fracture element.

It is to be particularly noted that the vials are shorter in length and narrower in width of slots or openings 33 and 34. Therefore, only the holder 29 retains the vials and the vials do not touch, bear against or are supported by the sidewall or bottom panel. The vial would fall through its associated slot if it were not for the holder retainers or rings 61 and 62.

Therefore, it can be seen that a pair of vials are employed which are retained within the rings 61 and 62 and that are separated by the body 60. Each of the respective vials 23 and 28 contain a garment-staining substance so that efforts to manipulate the tag for unauthorized removal purposes will result in movement of the fracturing element 22 so as to cause breakage of the vials and release of the substance within. Compressive fracture of the vials expels the theft-deterrent or garment-staining substance so that the substance will penetrate the garment 14 and mark the garment in an undesired manner.

FIG. 3 also illustrates the bottom panel 17 for the first housing 11 and illustrates a central opening 30 in which the body 60 and the shank of pin 12 passes exteriorly of the first housing 11. The panel 17 further includes a plurality of upright wall segments, such as segment 31, which form a perimeter for receiving the continuous wall 21 of the first housing. Attachment is made through conventional means such as heat sealing, frictional engagement or snap-lock connection. The panel further includes spacer posts or ribs 32 adapted to maintain separation between the cover of the first housing 11 and the opposing surface or face of the bottom panel 17. Of most importance, there is provided the pair of elongated slots identified by numerals 33 and 34 in the panel 17 which are in spaced-apart relationship with respect to the fragile vials 23 and 28 respectively. The diameter of the circular vials or the width thereof in cross-section is less than the width of the respective slots 33 and 34 so that the vials cannot rest on top of the slots. The slots are therefore employed only to permit release and passage of the theft-deterrent substance exteriorly of the first housing 11 and do not mount or retain the vials in position on the panel 17. The opening 30 is disposed between the slots 33 and 34 so that the pin 12 may pass therethrough without interfering with the vials. Additionally, the body 60 of the holder carrying the fracturing device 22 is inserted through the opening or passageway slot 30 in loose mounting on the panel 17. By loose mounting along with loose mounting of the breaker bar 22 in opening 63, it is meant that the fracturing device 22 may be flexed or pivoted to either side of the central longitudinal axis of the elongated housing 11 so that pressure is placed on either one of the vials 23 or 28 by the respective arcuate portions 25 or 26.

FIG. 3 further illustrates that an electric circuit 50, such as an antenna with a diode 52, is held against the cover 11 by the ribs 32 and 32'. The fracturing bar or device 22 includes recesses for accommodating the diode as it connects between connective strips of the circuit. The top surface of each rib bears against the adjacent side of the circuit. No other means is needed to retain the circuit in place.

The second housing 13 includes the conical opening 16 in the pressure plate 20 so as to receive and center the shank of the pin 12 as it passes into the receptacle 15 on bottom panel 18. The panel 18 includes a raised island 35 having a central opening leading into the receptacle 15. The opening is identified by numeral 36 and the opening separates segments 37 and 38 which are used to center and mount a lock panel 40. The lock panel 40 includes lateral ears, such as ear 41, which rests on the segments 37 and 38 and the opposite ends of the panel 40 rest on integral nubs 42 and 43 carried on the raised island 35. The lock panel 40 has a central lock mechanism comprising bendable flaps, such as flap 44, whereby insertion of the pin 12 through the opening 16 causes the shank of the pin to penetrate between the flaps 44 for entry into the receptacle 15. However, upon reverse or attempted withdrawal of the pin from the receptacle, causes a binding between the pin and the flaps 44 so that such separation or forcible urging of separation between the first and second housing is restricted if not prevented.

Referring now in detail to FIG. 4, it can be seen that when the housing 11 is aligned with the second housing 13, the shank of pin 12 is centered through the opening 16 so as to be insertably received between the flaps 44 of the lock mechanism as the pin progresses into the receptacle 15. The flaps 44 are arranged so that when the pin progresses in the direction towards the receptacle 15, the flaps will bend outwardly to permit passage of the pin. However, when the pin is moved in the opposite direction, the flaps frictionally engage with the pin 12 to draw the flaps upward into a binding relationship so that the pin cannot be readily removed. When authorized removal is desired, a special removal tool is used for separating the first and second housings and when the tool is used for such authorized disassembly, no damage is done to either of the components.

In FIG. 5, the components have been assembled so that the pin 12 is firmly held by the lock mechanism comprising flaps 44. The material 14 separates the opposing surfaces of the housing 11 and the housing 13.

In FIG. 6, the housings 11 and 13 are joined together, as previously described with respect to FIG. 5, and such an assembly is achieved without breaking of the vials 23 or 28. It can be seen that the vials are held within the ring retainers 61 and 62 of the holder 29. It can also be seen that the fragmenting element 22, as shown in FIG. 7, rocks about axis or point 46.

Therefore, the element 22 is permitted to pivot or move about a central longitudinal axis represented by the point 46. It can also be seen that the vials 23 and 28 do not rest on the edges of the bottom plate or panel 17 which define the elongated slots 33 and 34. Therefore, the vials 23 and 28 are supported only by the holder rings or retainers 61 and 62.

Referring now in detail to FIG. 7, it can be seen that as the element 22 is wobbled, flexed or moved so that the laterally extending arcuate portions 25 and 26 wobble, a compressive force is placed on the respective vials. As illustrated, the element 22 is moved laterally about the pivot 46 so that a compressive load or force is placed on the vial 23 causing the vial to break and dispense its theft-deterrent substance through slot 34 into the material 14. The substance is identified by numeral 47 in its flowable condition penetrating the material 14. It is to be understood that should the housing 11 be tampered with in such a manner that the element 22 flexes in the opposite direction, then arcuate portion 26 will break the vial 28 so that the substance will flow externally of the housing 11 via slot 33 into the garment fabric 14. Thus, when the fracturing means, such as element 22, is displaced into a fracturing relationship with either of the vials 23 or 28, the theft-deterrent substance will be released.

Referring now to the structure as disclosed in FIGS. 1–7, an electronic surveillance means taking the form of the circuit board 50 is shown on which a variety of components, such as a diode 51, may be mounted and wherein the components are joined together by a printed circuit layout, indicated by the lands, such as land or strip 52. The circuit 50 is placed between the fracturing means 22 and the underside of the case for the first housing 11 so that the circuit will not interfere with displacement of the fracturing means 22 during unauthorized tampering with the unit. Ribs 32 and 32' hold the circuit in place. The electronic surveillance means is responsive to incident energy, such as RF energy, to transmit alarm-indicating signals to remote apparatus to generate remote alarm indication on efforts to unauthorized separation of the tag from articles to which the tag is applied. Such tags have been equipped with means for outputing alarm indication on such unauthorized separation efforts. However, it is to be understood that the electronic circuitry used on circuit board 50 is conventional and the circuit arrangement does not form a part of the present invention.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A theft deterrent garment tag comprising:

a first housing having an internal cavity in communication exteriorly via at least one slot;

at least one fragile vial containing a garment staining substance disposed adjacent to said housing slot;

fracturing means movably carried in said first housing operable to fracture said vial in response to movement of said fracturing means;

an electronic surveillance circuit mounted in said first housing operable to respond in the event of an unauthorized theft situation;

a second housing including a receptacle and attachable to said first housing;

a pin element projecting from said first housing insertably engageable with said receptacle to secure said first housing to said second housing;

said first housing includes a panel closing said cavity and at least a pair of slots spaced apart;

said panel having a central opening between said pair of slots movably supporting said fracturing means therein;

said fracturing means including a central portion with outwardly laterally projecting arms extending from opposite sides thereof; and said pair of vials carried on said arms separated by said central portion.

2. The invention as defined in claim 1, wherein:

said opening adapted to bear against said electronic surveillance circuit.

3. The invention as defined in claim 2 wherein:

said arms include an open-ended receptacle occupied by said fragile vial.

4. The invention as defined in claim 3 wherein:

said arm include one arm outwardly extending from opposite sides of said central portion; and said fragile vial includes a pair of fragile vials, each one of said pair carried within said open-ended receptacle in each of said arms.

5. The invention as defined in claim 4 wherein:

said electronic surveillance circuit and said fracturing means operate independently of each other in response to the event of an unauthorized theft situation.

6. A theft deterrent garment tag comprising:

an attachable housing for installation onto a garment;

said housing having a first section with combined electronic surveillance means and garment staining means and further having a second section with fastening means for securement with said first section;

said garment staining means having a pair of fragile vials containing a garment staining substance;

a movable fracturing element carried on said first section supporting said pair of fragile vials in spaced relationship with respect to said first section; and said fragile vials adapted to engage said first section in response to movement of said fracturing element to break causing said garment staining substance to enter the garment.

7. The invention as defined in claim 6 including:

said first section having a panel provided with a pair of spaced-apart slots;

said fragile vials normally supported in spaced relationship with respect to said slots by said fracturing element and brought into breakable relationship with respect to said panel and said slots in response to movement of said fracturing element.

8. The invention as defined in claim 7 including:

an electronic surveillance circuit disposed in said first section in spaced-apart relationship with respect to said fracturing element whereby said fracturing element moves without interference with said electronic surveillance circuit.

9. The invention as defined in claim 8 wherein:

said first section includes spacer ribs bearing against said electronic surveillance circuit maintaining said spaced-apart relationship between said electronic surveillance circuit and said fracturing element.

10. The invention as defined in claim 9 wherein:

said fracturing element includes a central portion separating a pair of arms;

each of said arms having a retainer means engageable with each of said pair of fragile vials for securing each of said fragile vials to said fracturing element; and pivotal mounting means joining said fracturing element with said first section allowing lateral pivotal movement of said fracturing element about a longitudinal axis of said first section to break said fragible vials in response to unauthorized theft.

* * * * *